US010670366B2

(12) United States Patent
Estrella Molina

(10) Patent No.: US 10,670,366 B2
(45) Date of Patent: Jun. 2, 2020

(54) DUAL AND OMNIDIRECTIONAL BASE PLATE FOR MORTAR CARRIER VEHICLES

(71) Applicant: NEW TECHNOLOGIES GLOBAL SYSTEMS, S.L., Collado Villalba (Madrid) (ES)

(72) Inventor: Javier Estrella Molina, Collado Villalba (ES)

( * ) Notice: Subject to any disclaimer, the term of this patent is extended or adjusted under 35 U.S.C. 154(b) by 0 days.

(21) Appl. No.: 16/327,314

(22) PCT Filed: Oct. 6, 2016

(86) PCT No.: PCT/ES2016/070711

§ 371 (c)(1),
(2) Date: Feb. 21, 2019

(87) PCT Pub. No.: WO2018/065638

PCT Pub. Date: Apr. 12, 2018

(65) Prior Publication Data

US 2019/0178601 A1 Jun. 13, 2019

(51) Int. Cl.

| | |
|---|---|
| ***F41A 23/54*** | (2006.01) |
| ***F41F 1/06*** | (2006.01) |
| ***F41A 27/06*** | (2006.01) |
| ***F41A 23/34*** | (2006.01) |

(52) U.S. Cl.

CPC ..... *F41A 23/54* (2013.01); *F41A 23/34* (2013.01); *F41A 27/06* (2013.01); *F41F 1/06* (2013.01)

(58) Field of Classification Search

CPC ..... F41A 23/00; F41A 23/26; F41A 23/52; F41A 23/54; F41A 23/34; F41F 1/06

USPC ..... 89/1.3, 37.05, 37.01, 1.35, 40.02

See application file for complete search history.

(56) References Cited

U.S. PATENT DOCUMENTS

| | | | | |
|---|---|---|---|---|
| 4,495,852 A * | 1/1985 | Winkler | F41A 9/16 | 89/37.13 |
| 7,140,290 B2 * | 11/2006 | Borgwarth | F41A 23/26 | 89/37.05 |
| 2005/0241468 A1 * | 11/2005 | Borgwarth | F41A 23/26 | 89/40.02 |

(Continued)

FOREIGN PATENT DOCUMENTS

| | | | |
|---|---|---|---|
| DE | 3121998 A1 * | 12/1982 | F41A 23/00 |
| DE | 3121999 A1 * | 12/1982 | F41A 23/00 |

(Continued)

*Primary Examiner* — Jonathan C Weber

(74) *Attorney, Agent, or Firm* — Legends Law Group, PLLC; Stephen H. Bean, Esq.

(57) ABSTRACT

A dual and omnidirectional mortar base plate to be used in mortar carrier vehicles comprising a bottom base plate coupled to a mortar and a top base plate; wherein the dual base plate is adapted to move along a movement path from a resting position, associated with a position for movement of the vehicle, towards a work position associated with a firing position for the mortar, and vice versa. Likewise the dual base plate has elements for fast stowage in the mortar carrier vehicle.

The dual base plate consists of a bottom base plate, a top base plate, and connection and repositioning elements between the two to facilitate the transfer of the forces generated by said firing to the ground, isolating the mortar carrier vehicle from the forces generated by firing the mortar. Truncated cone shaped hoppers allow the bottom plate to move in any direction in which the mortar is fired.

1 Claim, 5 Drawing Sheets

(56) References Cited

U.S. PATENT DOCUMENTS

| | | | | |
|---|---|---|---|---|
| 2012/0024135 | A1* | 2/2012 | Kohnen | F41A 27/22<br>89/1.3 |
| 2015/0233673 | A1* | 8/2015 | Kohnen | F41F 1/06<br>89/41.17 |

FOREIGN PATENT DOCUMENTS

| | | | | |
|---|---|---|---|---|
| EP | 0066161 | A3 * | 2/1983 | F41A 9/16 |
| FR | 2663727 | A1 * | 12/1991 | F41A 23/34 |
| WO | WO-2016020558 | A1 * | 2/2016 | F41A 27/24 |

* cited by examiner

DUAL AND OMNIDIRECTIONAL BASE PLATE FOR MORTAR CARRIER VEHICLES

FIELD OF THE INVENTION

The present invention relates to a dual and omnidirectional base plate for mortar carrier vehicles where the base plate is capable of transferring to the ground the forces generated when firing a mortar in any direction, isolating the vehicle from said forces and facilitating the stowage thereof.

BACKGROUND OF THE INVENTION

A self-driven mortar or mortar carrier vehicle (mortar carrier) is a weapon system comprising a mortar assembled in a vehicle like the one described in ES 1078083 U (ESTRELLA MOLINA, Julio), in US 20120024135 A1 (KOHNEN Norbert et al.), in US 20050241468 A1 (Borgwarth Dennis W. et al.) or in U.S. Pat. No. 2,818,781 (Ruf Walter). The vehicle comprises a cargo area adapted for receiving the mortar.

In some cases, firing is performed with the mortar placed directly on the transport vehicle like in U.S. Pat. No. 4,791,852 A (Fraud Michel et al.). This requires suitable reinforcement of the suspension and cargo parts of the transport vehicle, the inclusion of elastic devices for absorbing the recoil and the forces generated by firing the mortar on the vehicle (like in U.S. Pat. No. 4,791,852, Fraud Michel et al.), and/or hydraulic jacks or supports for fixing the vehicle to the ground like in U.S. Pat. No. 2,818,781 (Ruf Walter).

In other cases the mortar has two positions, a traveling position, i.e., the mortar is placed on the support plate to be transported while the vehicle is traveling; and a firing position, in which the mortar leaves the cargo area of the vehicle and is located in the firing position on the ground, as described in ES 1078083 U (ESTRELLA MOLINA, Julio) and in US 20120024135 A1 (KOHNEN Norbert et al.).

In this latter case (US 20120024135 A1), the mortar barrel is coupled to a base plate of the mortar and to a supporting device which in turn is coupled to the cargo area of the transport vehicle mechanically or by means of articulated arms. The plate or supporting device is coupled to the vehicle mechanically for positioning the mortar between a traveling position, in which the mortar is placed for transport with the vehicle, and a firing position, in which the mortar is located for firing a shell from outside of the vehicle.

The base plate of the mortar in its deployed position is a base plate of a part which is driven into the ground on which the mortar barrel is placed, like in US 20120024135 A1 (KOHNEN Norbert et al.), where it is necessary to prepare the ground below the base plate to bury or drive it into said ground. The base plate of the mortar is coupled to the vehicle mechanically or by means of articulated arms like in ES 2203810 T3 (WINTER UDO ING MAG et al.), which causes a large part of the forces generated by firing the mortar to be transmitted to the vehicle.

As the aforementioned systems do not satisfactorily resolve the effect of the forces generated by firing the mortar on the vehicle, they must be provided with elements for absorbing recoil, hydraulic jacks, supports, or other elements for fixing the vehicle to the ground, structural reinforcements of the vehicle to withstand the transferred forces or accept that the necessary maintenance of the mortar carrier vehicle is more substantial or that the service life of the mortar carrier vehicle assembly is reduced as the entire assembly is subjected to the forces generated by all the firing of the mortar during operations.

SUMMARY OF THE INVENTION

The present invention seeks to overcome one or more of the drawbacks in mortar carrier vehicles described above by means of a dual base plate transferring the forces caused by firing the mortar to the ground, reducing or eliminating those forces transferred to the vehicle, which does not need any type of preparation of the ground on which the base plate is seated and allows a fast stowage.

The base plate consists of two clearly distinguished parts, a top base plate formed by a rectangular structure mechanically connected to and integral with the vehicle, and a rectangular bottom base plate on which the mortar is located. The top base plate is attached to the bottom base plate by means of several limiter cables.

The bottom base plate consists of a planar plate with several self-centering shafts integrally attached to its top face, and several metallic elements integrally attached to the bottom face of the planar plate and supporting the bottom base plate on the ground. The bottom base plate has a surface noticeably larger than the base plates used in existing mortars and mortar carrier vehicles for better transfer to the ground of the forces generated in the firing of the mortar, and is preferably rectangular-shaped. The design of said bottom base plate, which is planar and has a large surface, allows the bottom base plate to be placed directly on the ground while firing without needing to prepare the ground below the base plate or burying or driving it in said ground as occurs in existing mortars and mortar carrier vehicles.

The top base plate is preferably a rectangular-shaped structure with several truncated cone shaped hoppers integrally attached to the rectangular structure and a pressure-applying post also integrally attached to the rectangular structure. The top base plate is placed on the bottom base plate. The top base plate exerts pressure on the bottom base plate by using a drive exerting a force on the pressure-applying post for the purpose of obtaining a higher transfer of the forces generated in the firing to the ground. The bottom base plate is firmly supported on the ground as it is pressed through the top base plate with the weight of the vehicle.

The assembly of the bottom and top base plates allows a fast positioning and stowage of the mortar assembly in the mortar carrier vehicle to return to the vehicle traveling position by means of a stowing system for stowing the bottom base plate, located in the top plate and having two positions: a locked position and a released position.

Figure 1:
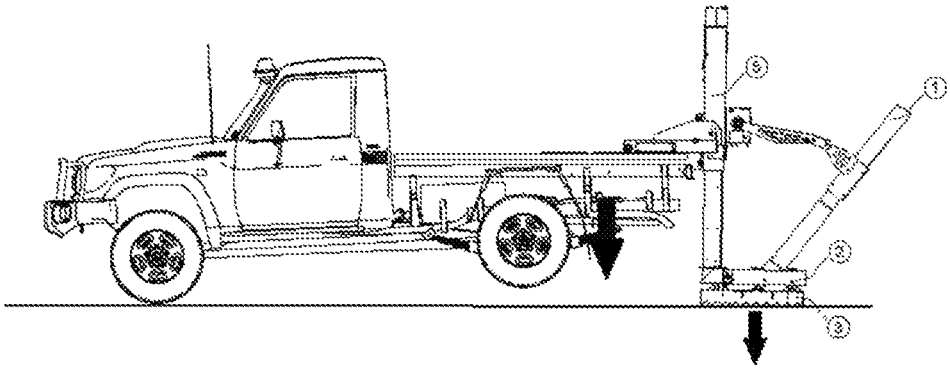
FIG. 1 illustrates the dual base plate assembly and mortar in the deployed position outside of the mortar carrier vehicle, with the mortar located in the firing position.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION OF THE INVENTION

Reference will now be made in detail to the presently preferred embodiments of the invention. There are also representative examples of the invention illustrated in the accompanying drawings. Throughout the following detailed description, the same reference numeral refers to the same elements in all figures.

FIG. 1 shows a dual mortar base plate used in a mortar carrier vehicle where a mortar 1 is mechanically coupled to a cargo area of a mortar carrier vehicle through an extendable mechanical arm or other means.

Figure 2:
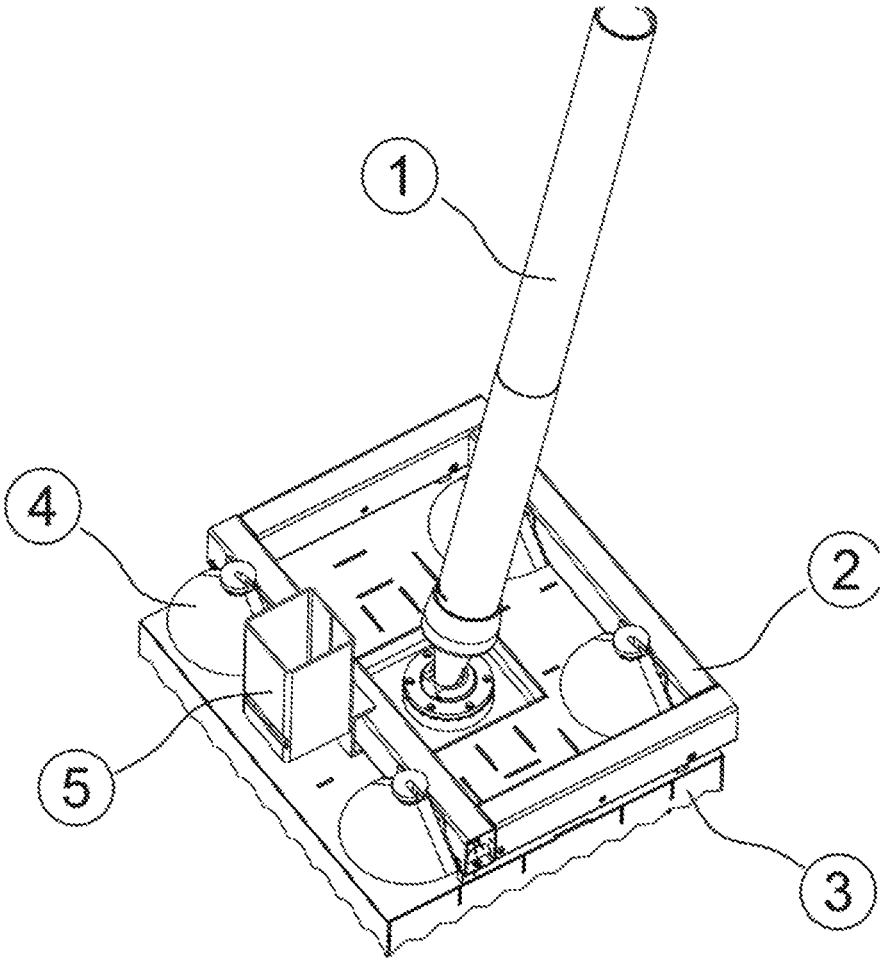
FIG. 2 illustrates a perspective view of the dual base plate assembly and its main elements: mortar barrel, top base plate, bottom base plate, hoppers and pressure-applying post.

FIG. 2 shows a perspective view of the dual base plate assembly and its main elements: mortar barrel 1, top base plate 2, bottom base plate 3, hoppers 4, and pressure-applying post 5.

The mortar can adopt two positions, one is the traveling position which corresponds to the resting position of the mortar 1 positioned in the cargo area of the mortar carrier vehicle for traveling with the vehicle; and a second work position corresponding to a firing position for the mortar (shown in FIG. 1). In the firing position, the mortar 1 is supported directly on the bottom base plate 3 which in turn is supported against the ground, near the vehicle and outside same.

Figure 3:
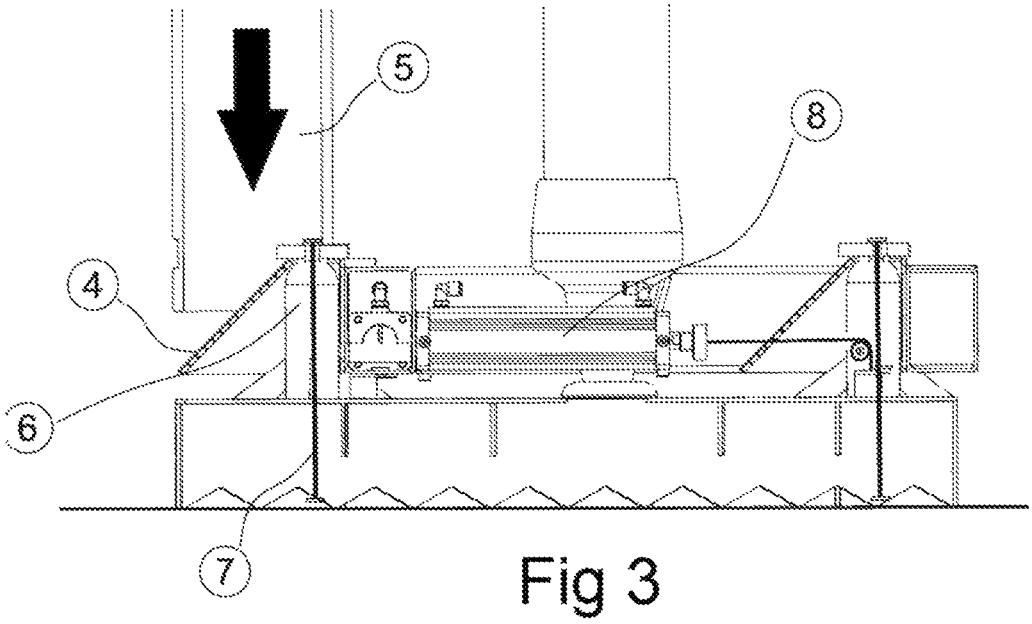
FIG. 3 illustrates the dual base plate in the locked position of the stowing system for stowing the bottom base plate.

In FIG. 3 it can be observed, in the locked position of the stowing system 8 for stowing the bottom base plate 3, the mortar barrel 1, the top base plate 2, the bottom base plate 3, the hoppers 4, the pressure-applying post 5, the self-centering shafts 6 of the bottom base plate, the limiter cables 7 joining the top base plate with the bottom base plate, the stowing system for stowing the bottom base plate 8 in the locked position, the upper stops 9, and the lower stops 10.

Figure 4:
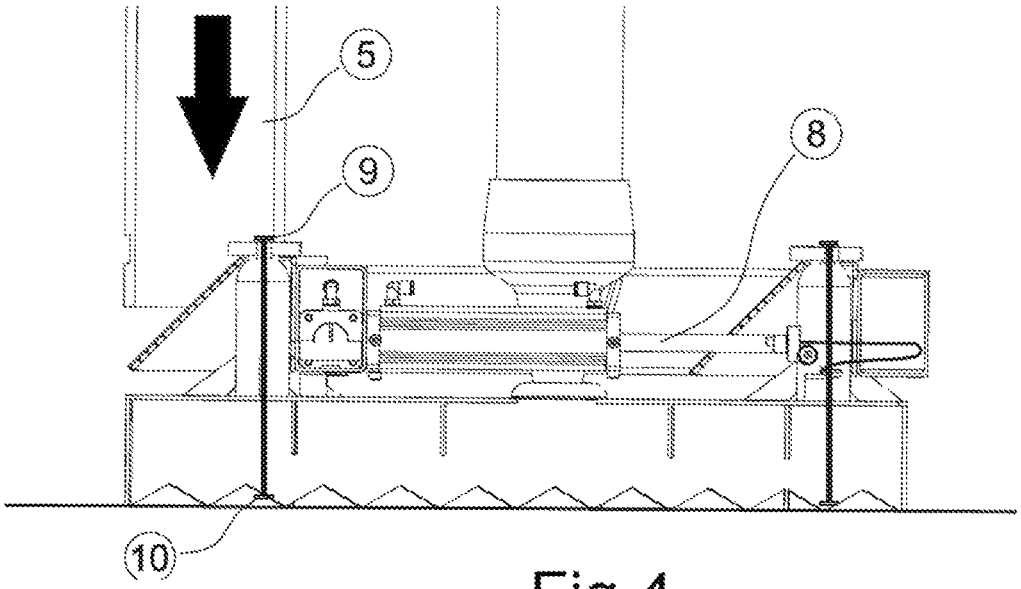
FIG. 4 illustrates the dual base plate in the released position of the stowing system for stowing the bottom base plate.

In FIG. 4 it can be seen, in the released position of the stowing system for stowing the bottom base plate, the mortar barrel 1, the top base plate 2, the bottom base plate 3, the hoppers 4, the pressure-applying post 5, the self-centering shafts 6 of the bottom base plate, the limiter cables 7 joining the top base plate with the bottom base plate, the stowing system for stowing the bottom base plate 8 in the released position, the upper stops 9 and the lower stops 10.

Figure 5:
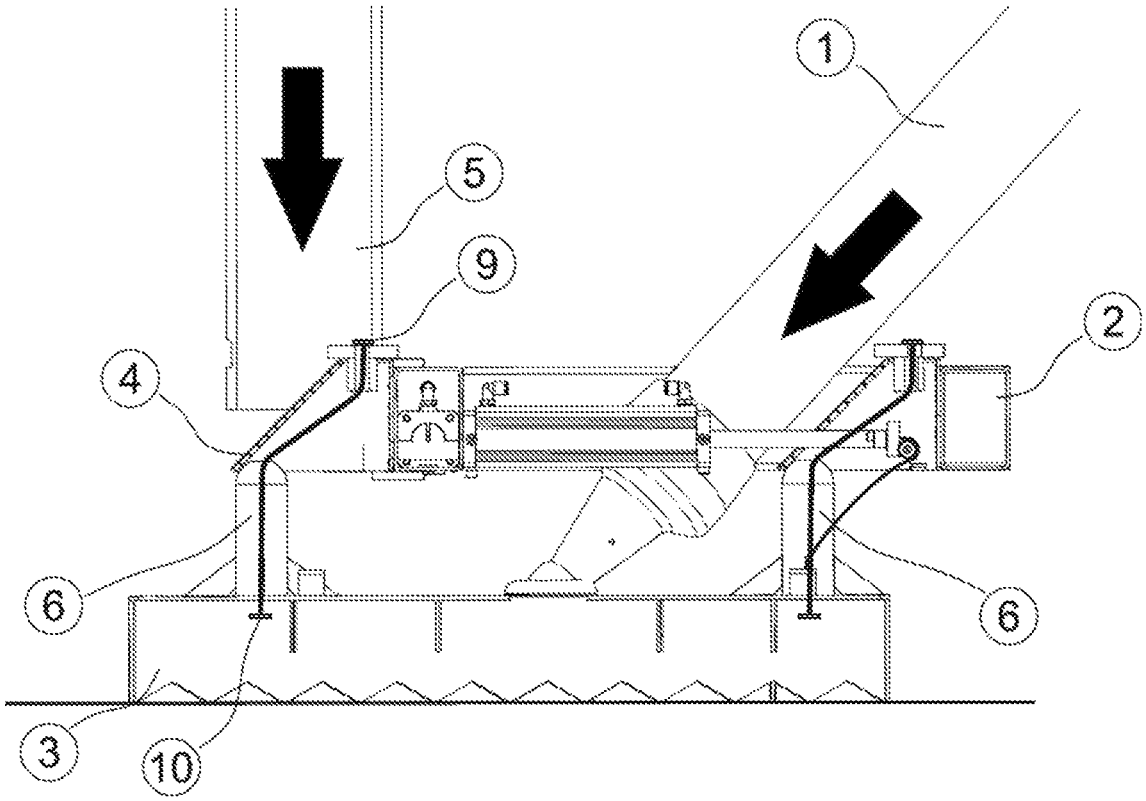
FIG. 5 illustrates the dual base plate in the released position of the stowing system for stowing the bottom base plate right after the mortar has been fired.

In FIG. 5 it can be observed, in that same position of the stowing system, the mortar barrel 1, the top base plate 2, the bottom base plate 3 on the ground moved backwards due to the recoil of the mortar barrel during firing, the hoppers 4, the pressure-applying post 5, the self-centering shafts 6 of the bottom base plate, the limiter cables 7 joining the top base plate with the bottom base plate, the stowing system for stowing the bottom base plate 8 in the released position, the upper stops 9 and the lower stops 10.

The pressure-applying post 5 has a mechanism which allows it to increase its length so that the dual base plate reaches the ground, presses against it, and raises the rear part of the vehicle. This force exerted by the pressure-applying post assures that the dual base plate is securely seated on the ground, with the surface of the ground being responsible for absorbing the recoil energy. FIG. 1 shows the dual base plate seated on the ground after the force has been exerted on the pressure-applying post 5. It can be observed in FIG. 1 how the rear part of the vehicle may be raised slightly above the level of the ground.

The bottom base plate 3 has a surface noticeably larger than standard mortar base plates and comprises mechanical elements located on the bottom surface of the bottom base plate, which are located on the ground and allow improving the transfer of the forces generated by firing the mortar to the ground. As a result of its design and the force exerted on the pressure-applying post 5, the bottom base plate 3 is firmly supported on the ground as it is pressed through the top base plate 2 with the weight of the vehicle, as observed in FIG. 1.

The bottom edge of the bottom base plate 3 is provided with jagged edges to facilitate driving the plate into the ground.

The lower end of the mortar barrel 1 is mechanically assembled to the bottom base plate 3 by means of a ball and socket joint system.

The top base plate 2 and the bottom base plate 3 are attached and the movement thereof is limited by limiter cables 7. The limiter cable 7 is secured to the hoppers 4 of the top base plate by means of an upper stop 9, as shown in FIG. 4. The limiter cable 7 is secured to the bottom base plate 3 by means of a lower stop 10, as shown in FIG. 4. The limiter cables 7 pass through the inside of the self-centering shafts 6 of the bottom base plate 3, as shown in FIG. 4.

Once the dual base plate is located on the ground, the stowing system 8 for stowing the bottom base plate is actuated such that it transitions from the locked position (see FIG. 3) to the released position (see FIG. 4).

The top base plate 2 is supported on the bottom base plate 3 at several (three or more) points by means of truncated cone shaped hoppers 4 of a given angle so that after firing, the vehicle moves slightly to the new position of the bottom base plate. These conical supports or hoppers 4 allow the bottom base plate 3 to move at any strike angle upon firing the mortar within the limits allowed by the length of the limiter cables 7, as shown in FIG. 5. As can be observed, the self-centering shafts 6 move inside the hoppers 4 within the limits allowed by the limiter cables 7, the upper stops 9, and the lower stops 10.

The forces generated by the recoil of the mortar barrel 1 during firing are transferred to the ground through the bottom base plate 3, which may cause the bottom base plate 3 to move a short distance to the side in any direction on the ground, as observed in FIG. 5. This allows isolating the top base plate 2 and the mortar carrier vehicle from the forces generated by the firing, at the same time limiting the stress to which the mortar carrier vehicle assembly and the elements attaching the mortar to said vehicle are subjected.

Figure 6:
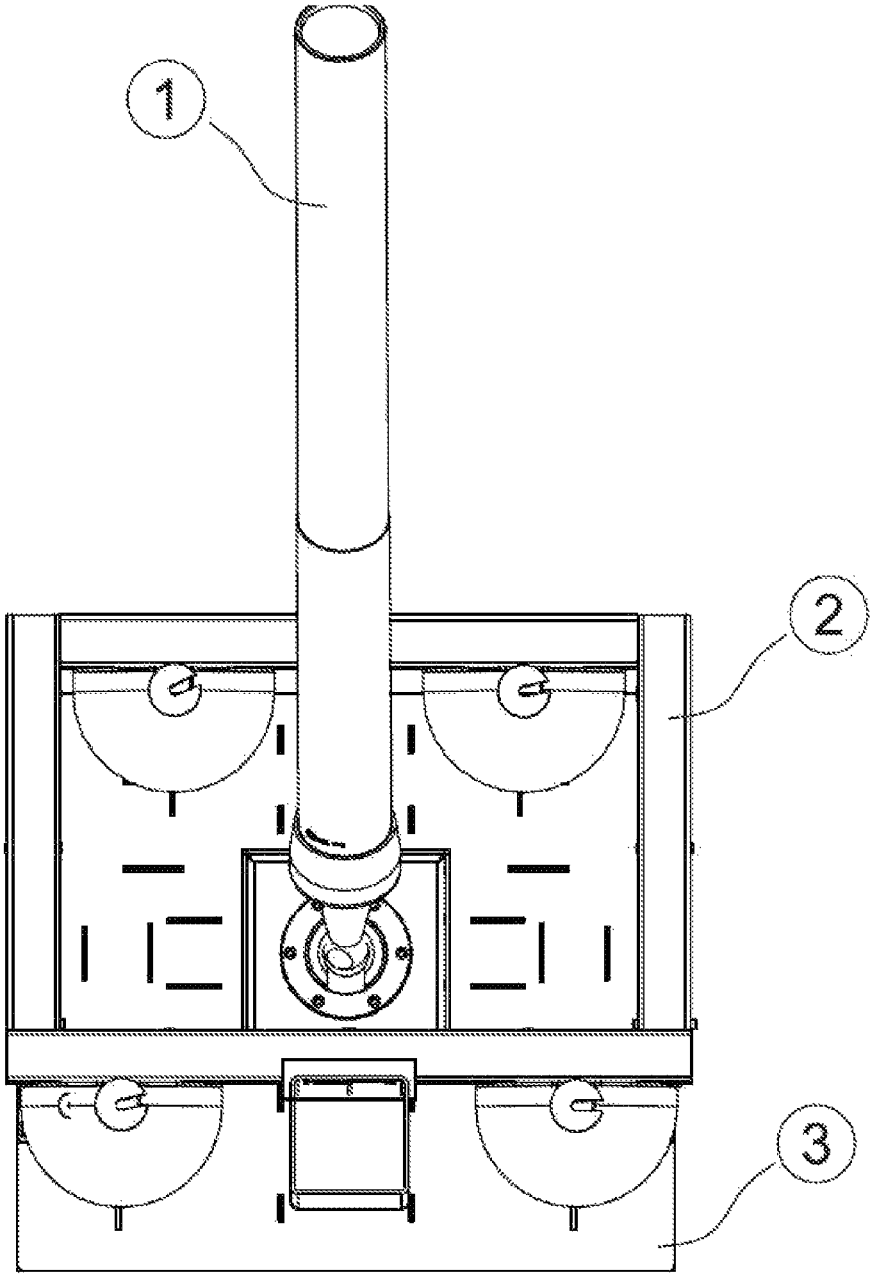
FIG. 6 shows a top view of the dual base plate right after the mortar has been fired.

In FIG. 6, the mortar barrel 1, the top base plate 2, the bottom base plate 3 on the ground moved to the left due to mortar barrel recoil during firing, the hoppers 4, the pressure-applying post 5 and the upper stops 9 right after the mortar has been fired can be observed.

In that moment, the force exerted (weight of the vehicle) on the top base plate 2 makes the top base plate (and with it the vehicle to which it is integrally attached) move until it is located again on the bottom base plate 3, i.e., it returns to the position of FIG. 4 by means of the hoppers 4 sliding on the self-centering shafts 6 until the central axis of the hoppers 4 is aligned with the self-centering shafts 6.

Figure 7:
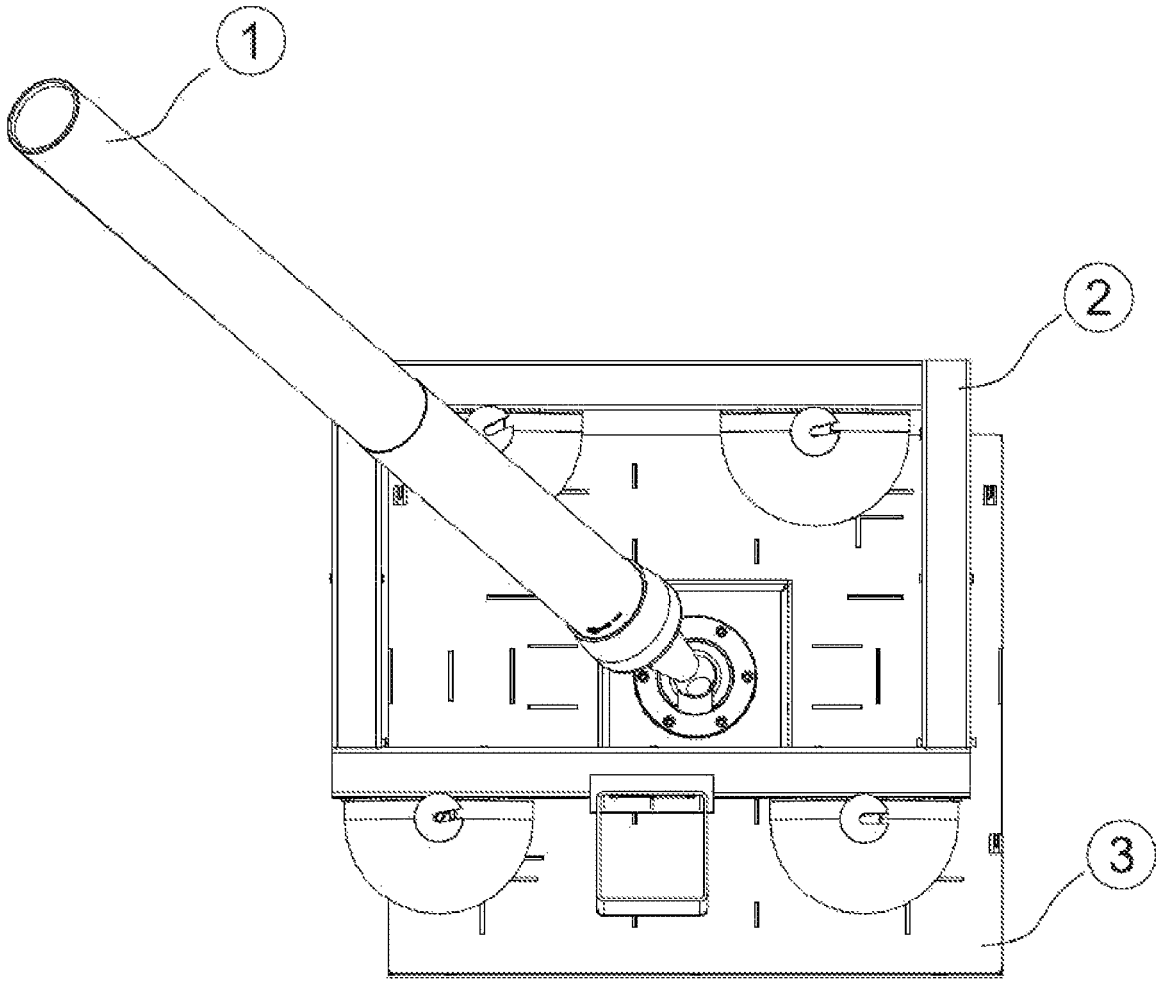
FIG. 7 shows a top view of the dual base plate right after the mortar has been fired with a mortar barrel azimuth and elevation angle different from that of FIG. 6.

To enable the mortar barrel 1 to fire in any direction without having to move the vehicle, the hoppers 4 have a truncated cone shape, whereby allowing the self-centering shafts 6 to move in the mortar thrust direction, as can be seen in FIG. 6 (the mortar fires with a strike angle of zero), and in FIG. 7, where the mortar fires with a strike angle of 60°.

Once the firing of the mortar has ended, to initiate stowage of the mortar, the stowing system 8 for stowing the bottom base plate is actuated such that it transitions from the released position (FIG. 4) to the locked position (FIG. 3). Then the force exerted by the pressure-applying post 5 on the dual base plate (for example through a drive no contemplated herein) is eliminated. At that time force is no longer being exerted on the dual base plate by the mortar carrier vehicle and stowage of the assembly can be initiated to transition to the transport position of the vehicle which corresponds to a resting position of the mortar positioned in the cargo area of the mortar carrier vehicle for traveling with the vehicle.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A dual and omnidirectional base plate for mortar carrier vehicles, comprising:

a bottom base plate to which the lower end of a mortar barrel is assembled by a ball and socket joint system, and comprising a planar plate with several self-centering shafts integrally attached to a top face of the planar plate, a top base plate comprising a structure with several truncated cone shaped hoppers integrally attached to the structure and whereby the top base plate is supported on self-centering shafts of said bottom base plate so that after firing, said top base plate and said vehicle are moved to a new position of said bottom base plate, said top base plate and said bottom base plate comprising limiter cables passing through the inside of said self-centering shafts, wherein said limiter cables are secured to said bottom base plate by lower stops and to said hoppers of said top base plate by upper stops, wherein said top base plate and said bottom base plate are connected to each other and have limited movement, and a pressure-applying post integrally attached to the structure of said top base plate at a lower end and to a cargo area of a mortar carrier vehicle.

* * * * *